United States Patent [19]

Gooding, Jr. et al.

[11] Patent Number: 4,963,406

[45] Date of Patent: Oct. 16, 1990

[54] ABSORBENT PAPER TOWEL OR TISSUE PRODUCT

[75] Inventors: Chester W. Gooding, Jr.; Maurice J. Mead, both of Neenah, Wis.

[73] Assignee: James River Corporation of Virginia, Richmond, Va.

[21] Appl. No.: 260,407

[22] Filed: Oct. 20, 1988

[51] Int. Cl.[5] ..... B32B 3/10

[52] U.S. Cl. ..... 428/43; 428/198; 428/906

[58] Field of Search ..... 428/43, 906, 198; 242/1

[56] References Cited

U.S. PATENT DOCUMENTS 2,266,958 12/1941 Corbin ..... 428/43

4,508,365 4/1985 Hawes ..... 428/43

*Primary Examiner*—Alexander S. Thomas

*Attorney, Agent, or Firm*—Richard J. Gallagher; Thomas H. Whaley

[57] ABSTRACT

An absorbent towel or tissue product of cellulosic fibers or other fibrous material in continuous roll or strip form is provided with a plurality of lines of weakness, suitably slits or knife cuts, delimiting the edges of individual sheets to facilitate detachment of sheets from the roll without longitudinal tearing of the towel or tissue and maintain bonding of the plies on the roll and in detached sheets.

1 Claim, 1 Drawing Sheet

ABSORBENT PAPER TOWEL OR TISSUE PRODUCT

This invention relates to improvements in absorbent paper products, especially paper toweling and bathroom tissue of cellulosic fibers normally marketed in roll form. In its usual form, the roll of tissue or toweling is perforated in the transverse direction to permit separation of individual sheets from the roll. In multi-ply tissue products, such perforations usually comprise a series of closely spaced knife cuts. These perforations produce a bond between the plies so that normally they do not separate from one another as the tissue is unrolled. When torn into sheets, the ply bonding between plies is weakened or sometimes destroyed.

With conventional perforation of these absorbent paper products, two problems are occasionally encountered. The most common problem is that in tearing a sheet from the roll, the tear follows the line of weakness, i.e. the series of knife cuts, only part of the way across the width of the paper and then tears in the longitudinal direction, leaving part of the sheet still attached to the roll. Another problem which sometimes occurs is a condition known as "ply mismatch". Ply mismatch occurs when the plies become separated from one another as they are unwound from the roll and the top ply is flipped over the top and to the rear of the roll, thus becoming the under ply. When this occurs, the lines of perforation do not match and as the roll is unwound ply separation continues until the plies are returned to their proper positions on the unrolled portion of the roll. This condition is recognizable also by the fact that a pattern printed on the outside ply on the roll appears between the plies of the severed sheets.

In accordance with this invention, the above mentioned problems are avoided or minimized by providing a plurality of closely spaced lines of weakness at the edge of each sheet. By providing two closely spaced lines of knife cuts, for example, separation of sheets from one another along the desired lines may occur by tearing along either or both sets of perforations. In some instances, the line of separation of a sheet from the roll may take place along a single line of knife cuts or along a path alternating between the lines or a path starting along one line and changing to the other. Further, the probability of tearing of the sheet outside the perforated area may be reduced by staggering the patterns of the perforations or by use of dissimilar patterns of perforations. In any event, the perforations which are not torn, serve to maintain a bond between plies avoiding the problems of ply separation.

Lines of weakness, usually knife cuts, are commonly used in paperboard packaging to permit "easy opening" of a package, or non-destructive opening of the package in such a way that it may be reclosed to protect the contents until used. Tear lines in cardboard formed by a cutter which produces closely spaced multiple rows of aligned, intermittent, closely spaced cuts are disclosed, for example, in U.S. Pat. Nos. 3,463,039 and 3,394,866 to Silver. As disclosed therein, the cuts are made across the grain of the cardboard for ease of tearing and to assure that tearing will take place only along the tear lines. The blades of the cutter may be arranged with their teeth in register with one another.

In the towel and tissue art, single rows of perforations to facilitate tearing are conventional and so far as known to us multiple, closely spaced rows of perforations have not been previously disclosed. Roberts et al 3,823,057 discloses a multi layer toilet paper having a plurality of rows of small perforations designed to permit passage of talc therethrough when in use. Conradson, 1,384,515 discloses a paper towel having a series of perforations covering the entire surface of the sheet. These perforations are designed to roughen the surface of the towel and increase its moisture absorption properties.

The towel and tissue products of this invention overcome the problems mentioned above by providing a plurality of rows of lines of weakness, e.g. knife cuts, at the edge of each sheet on a roll. The plural lines of weakness ensure clean separation of individual or multiple sheets from the continuous strip forming the roll. In one of its specific embodiments, this invention relates to a strip of toweling or toilet tissue in which individual sheets are delimited by plural rows of lines of weakness. In one of its more specific embodiments, parallel lines of weakness comprise knife cuts in which the individual cuts or slits are identical to one another in the two rows and directly opposite one another, i.e. the knife cuts in the second row are not offset relative to those in the first row. In another of its more specific embodiments, parallel lines of weakness comprise slits or knife cuts of identical length and longitudinal spacing in which the knife cuts in the second row are offset 100% from those of the first row as illustrated in FIG. 2 of the accompanying drawings. In still another of its more specific embodiments, the two rows of lines of weakness are made up of knife cuts of different lengths as illustrated in FIG. 3.

Figure 1:
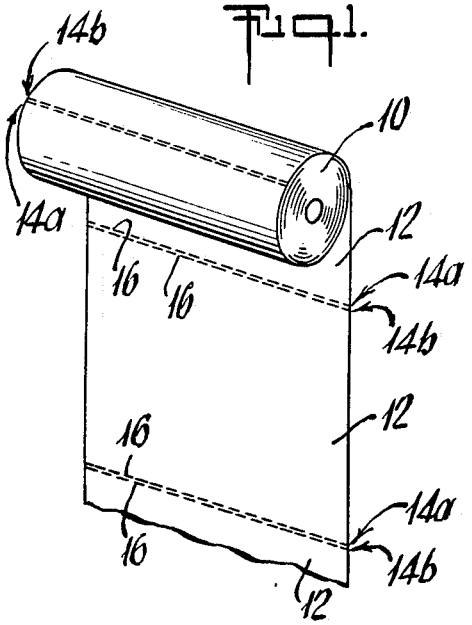
FIG. 1 is an isometric view of one embodiment of a roll of towel or tissue of this invention.

With reference to FIG. 1, a roll of paper is delimited into segmental sections 12 by a plurality of rows 14*a* and 14*b* of knife slits 16. As illustrated in this figure, the knife slits 16 are all of equal size. In this embodiment, the slits in one of the two closely spaced parallel lines of weakness are directly opposite those in the adjacent line. That is, there is 0 percent displacement of the slits in row 14*b* relative to those in row 14*a* as illustrated in more detail in FIG. 1*a*.

The lengths of the knife slits are generally in the range of about 0.06 to about 0.1 inch in toilet tissue with a spacing between slits in the range of about 0.03 to about 0.05 inch while the slit lengths in toweling generally are in the range of from about 0.1 to 0.15 inch with a spacing between slits in the range of form about 0.03 to 0.06 inch. In the products of this invention, the spacing between rows of slits, or lines of weakness, at the edge of each sheet are preferably in the range of from about 0.03 to 0.06 inch.

Figure 2:
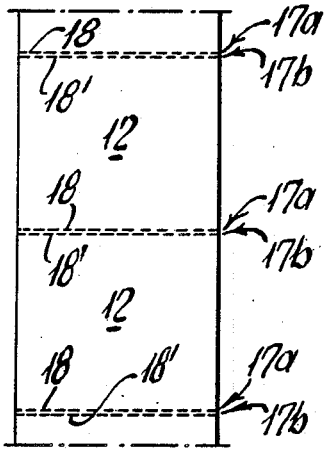
FIGS. 2 and 3 are plan views of strips of toilet tissue or toweling illustrating other embodiments of this invention with lines of weakness detailed in FIGS. 2*a* and 3*a*.
Figure 1A:
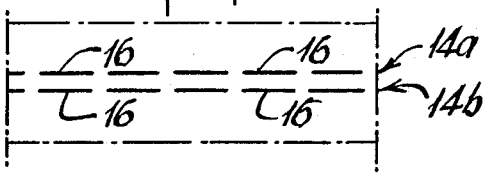
FIG. 1*a* is a detailed illustration of the pattern of slits illustrated in FIG. 1.
Figure 2A:
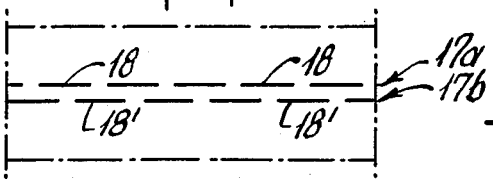

FIG. 2 illustrates another embodiment of this invention in which the knife slits 18 and 18' in adjacent lines of weakness 17*a* and 17*b* are offset longitudinally in the rows by 100 percent as illustrated in greater detail in FIG. 2*a*. The degree of offset of slits in the adjacent lines of weakness may range from 0 percent as illustrated in FIGS. 1 and 1*a* to 100 percent as illustrated in FIGS. 2 and 2*a*. In this embodiment, if the tear pattern shifts from line 17*a* to 17*b* along the machine direction of the sheet, the tear will be interrupted by the offset slits 18' in line 17*b*.

Figure 3:
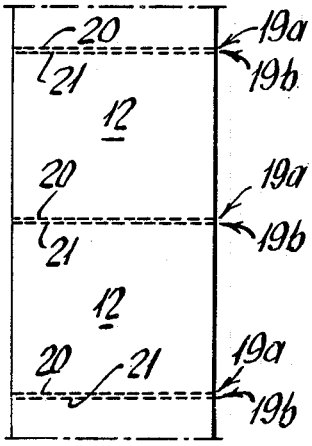
Figure 3A:
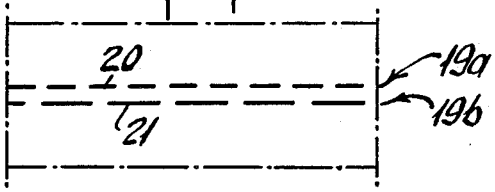

Another embodiment of this invention is illustrated in FIGS. 3 and 3*a*. In this embodiment, the knife slits in lines of weakness 19*a* and 19*b* are of different lengths. As illustrated, the slits 21 in line 19*b* are longer than slits 20 in line 19*a*, creating a more random tear pattern in the event that the line of tear shifts from one line of weakness to the other.

Figure 4:
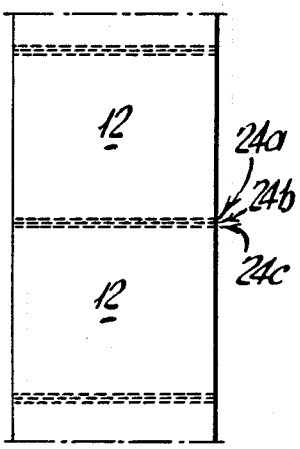
FIG. 4 is a plan view of a strip of tissue or toweling having multiple lies of weakness delimiting the edges of individual sheets.

As illustrated in FIG. 4, the edges of sheets 12 may be delimited by multiple lines of weakness 24*a*, 24*b*, and 24*c* extending transversely across the strip of toweling or toilet tissue. The patterns of slits in the lines of weakness may be any of those illustrated in FIGS. 1*a*, 2*a* or 3*a*, or any combination thereof.

In one embodiment of this invention, the lines of weakness 24*b* of FIG. 4 are provided with knife slits which are so constructed and arranged as to be weaker than lines of weakness 24*a* and 24*c* so that tearing occurs preferentially along line 24*b*. This embodiment is particularly useful and preferred when the tissue or toweling comprises two or more layers of fibrous sheets. The perforations in lines of weakness 24*a* and 24*c* serve to maintain the ply bonding of the multiple layers of tissue or toweling when a sheet 12 is detached from the strip or roll 10.

We claim:

1. An absorbent web in strip or roll form which comprises multiple plies of absorbent cellulosic or other fibrous material adapted for separation into separate sheets by lines of weakness extending transversely of the strip, and wherein the sheets are delimited by three parallel lines of weakness, the central line of weakness comprising knife cuts having a length and spacing such that is has a lower tear strength than the adjacent lines of weakness whereby a sheet detached from the strip separates from the strip primarily along the central line of weakness and the remaining lines of weakness maintain a bond between plies.

* * * * *